US006693579B2

(12) United States Patent
Baxter et al.

(10) Patent No.: US 6,693,579 B2
(45) Date of Patent: Feb. 17, 2004

(54) METHOD TO IMPROVE SEALING OF INK JET PRINTHEAD PURGE MECHANISM TO PRINTHEAD

(75) Inventors: Laura Garcia Baxter, Lexington, KY (US); John Edward Borsuk, Nicholasville, KY (US); Ronald Todd Sellers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 46 days.

(21) Appl. No.: 09/919,688

(22) Filed: Aug. 1, 2001

(65) Prior Publication Data

US 2003/0025755 A1 Feb. 6, 2003

(51) Int. Cl.[7] ..... B41J 2/165

(52) U.S. Cl. ..... 342/29; 347/27; 347/30; 347/32

(58) Field of Search ..... 347/27, 29, 35, 347/32, 30

(56) References Cited

U.S. PATENT DOCUMENTS

| | | | | |
|---|---|---|---|---|
| 4,543,591 A | | 9/1985 | Terasawa | |
| 4,567,494 A | | 1/1986 | Taylor | |
| 4,728,970 A | | 3/1988 | Terasawa | |
| 4,853,717 A | | 8/1989 | Harmon et al. | |
| 5,097,276 A | | 3/1992 | Midorikawa | |
| 5,440,331 A | | 8/1995 | Grange | |
| 5,517,219 A | | 5/1996 | Uchida | |
| 5,534,896 A | | 7/1996 | Osborne | |
| 5,543,827 A | | 8/1996 | VanSteenkiste et al. | |
| 5,563,637 A | | 10/1996 | Francis et al. | |
| 5,570,117 A | | 10/1996 | Karambelas et al. | |
| 5,621,441 A | | 4/1997 | Waschhauser et al. | |
| 5,644,346 A | | 7/1997 | Schwiebert et al. | |
| 5,670,997 A | | 9/1997 | Sugimoto et al. | |
| 5,712,668 A | | 1/1998 | Osborne et al. | |
| 5,717,444 A | | 2/1998 | Sugimoto et al. | |
| 5,757,396 A | | 5/1998 | Bruner | |
| 5,828,389 A | | 10/1998 | Yamaguchi et al. | |
| 5,883,647 A | | 3/1999 | Uchida | |
| 5,896,143 A | | 4/1999 | Matsui et al. | |
| 5,896,144 A | | 4/1999 | Kishimoto et al. | |
| 5,946,009 A | | 8/1999 | Youn | |
| 6,007,180 A | | 12/1999 | Muraki | |
| 6,010,203 A | | 1/2000 | Muraki | |
| 6,036,299 A | * | 3/2000 | Kobayashi et al. | 347/30 |
| 6,106,098 A | | 8/2000 | Nakamura et al. | |

* cited by examiner

*Primary Examiner*—Stephen D. Meier
*Assistant Examiner*—Lam Nguyen

(57) ABSTRACT

A method of improving a sealing between a purge mechanism and a printhead includes the steps of providing a purge cap with a perimetrical sealing lip; and exercising the perimetrical sealing lip of the purge cap against the sealing surface of the printhead. The exercising is effected by generating a repetitive relative movement between the sealing surface of the printhead and the perimetrical sealing lip of the purge cap.

32 Claims, 5 Drawing Sheets

METHOD TO IMPROVE SEALING OF INK JET PRINTHEAD PURGE MECHANISM TO PRINTHEAD

BACKGROUND OF THE INVENTION

1. Field of the Invention

The present invention relates to ink jet printers, and, more particularly, to a method to improve the sealing of an ink jet printhead purge mechanism to an ink jet printhead.

2. Description of the Related Art

A typical ink jet printer includes a reciprocating carriage, also known as a carrier, carrying at least one ink jet printhead. The printhead includes a nozzle plate having a plurality of ink jet nozzles. Associated with each nozzle is an actuator, such as an electric heater or piezoelectric device, that when electrically energized causes ink to be ejected from the respective ink jet nozzle. As a sheet of print media is transported in an indexed manner under the printhead, the printhead is scanned in a reciprocating manner across the width of an image area on the sheet of print media. At least a portion of the scan path of the reciprocating printhead defines a print zone. A platen is provided opposite to the printhead for contacting the non-printed side of the print media and, in part, defines the distance between the printhead and the sheet of print media. The actuators associated with the plurality of ink jet nozzles are selectively energized to form an image on the sheet of print media in the image area.

In order to maintain satisfactory printing quality on a continuous basis, printhead maintenance is performed. Typically, a maintenance or cleaning station is provided for cleaning nozzles and capping the nozzle plates to form an air seal around the nozzles to prevent ink from drying in the nozzles. The maintenance station includes at least one wiper, and one cup-shaped printhead cap for each printhead. Briefly, a wiping sequence commences with the printhead over the media feed path and the top of the wiper below the media feed path. The wiper is raised until it extends into the path of the printhead surface containing the nozzles, and the printhead is moved to engage the wiper. Thus, accumulated ink and other foreign matter are wiped from the printhead as the printhead moves past the wiper. In a typical capping operation, the printhead is moved over the printhead cap and the cap is raised into contact with the printhead in an attempt to form an air tight seal around the region in which the nozzles are located.

In addition to wiping and capping the printhead nozzles, some ink jet printers include a purge mechanism that performs a vacuum purging procedure by applying a vacuum to the printhead nozzle plate during a maintenance operation to remove obstructions from the plurality of nozzles and the region adjacent thereto on the nozzle plate. Such a purge mechanism typically includes an elastomeric purge cap for covering the printhead nozzles, a vacuum pump for establishing a negative pressure, and a hose coupling the purge cap to the vacuum pump. For example, in some ink jet printers such a vacuum purging procedure is necessary to eliminate micro bubbles from the nozzles and the areas adjacent to the printhead nozzles. The micro bubbles are generated primarily by mechanical shock such as, for example, that resulting from the installation of an ink tank or printhead cartridge on the printer. Secondary sources of obstructive bubbles include air bubbles formed during ink de-gasification and air ingested through the nozzles caused by the re-forming of an ink meniscus following ink ejection from the nozzles during normal printing. Also, the purging operation is used to remove soft plugs and contamination from inside the ink jet nozzles and the area surrounding the nozzles on the nozzle plate during a maintenance cycle.

The effectiveness of the vacuum purging procedure depends to a large extent on the ability to establish and maintain an airtight seal around the printhead nozzles during the vacuum purging procedure. However, in practice it has proven to be difficult to obtain a repeatable, airtight seal around an ink jet nozzle region in order to efficiently and effectively pull a vacuum on the printhead to purge the ink jet nozzles of the printhead.

What is needed in the art is a method to improve the sealing of an ink jet printhead purge mechanism to an ink jet printhead.

SUMMARY OF THE INVENTION

The present invention provides a method of improving a sealing between a purge mechanism and a printhead.

In one form of the invention, the method includes the steps of providing the purge cap with a perimetrical sealing lip; and exercising the perimetrical sealing lip of the purge cap against a sealing surface of the printhead. The step of exercising is effected by generating a repetitive relative movement between the sealing surface of the printhead and the perimetrical sealing lip of the purge cap.

In another form of the invention, the method includes the steps of engaging the printhead with a purge cap; moving the printhead in a first direction away from the purge cap while maintaining contact between the printhead and the purge cap; moving the printhead bi-directionally in a reciprocating fashion while maintaining contact between the printhead and the purge cap; and moving the printhead in a second direction toward the purge cap.

In still another form thereof, the present invention provides a method of sealing a purge mechanism to a printhead surface of a printhead, including the steps of engaging the printhead surface with a purge cap; vertically raising the printhead while maintaining contact between the printhead surface and the purge cap; horizontally moving the printhead bi-directionally in a reciprocating fashion while maintaining contact between the printhead surface and the purge cap; and vertically lowering the printhead.

In still another form thereof, the present invention provides a method of improving a sealing between a purge cap of a purge mechanism and a printhead having a printhead surface, including the steps of engaging the printhead surface with the purge cap; decreasing a force exerted between the purge cap and the printhead surface while maintaining contact between the printhead surface and the purge cap; moving at least one of the printhead and the purge cap bi-directionally in a reciprocating fashion while maintaining contact between the printhead surface and the purge cap; and increasing the force exerted between the purge cap and the printhead surface.

An advantage of the present invention is that the sealing between a purge mechanism and a printhead is improved while utilizing existing printer hardware technology.

Another advantage is that the sealing between a purge mechanism and a printhead is improved without replacing any printer hardware components.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
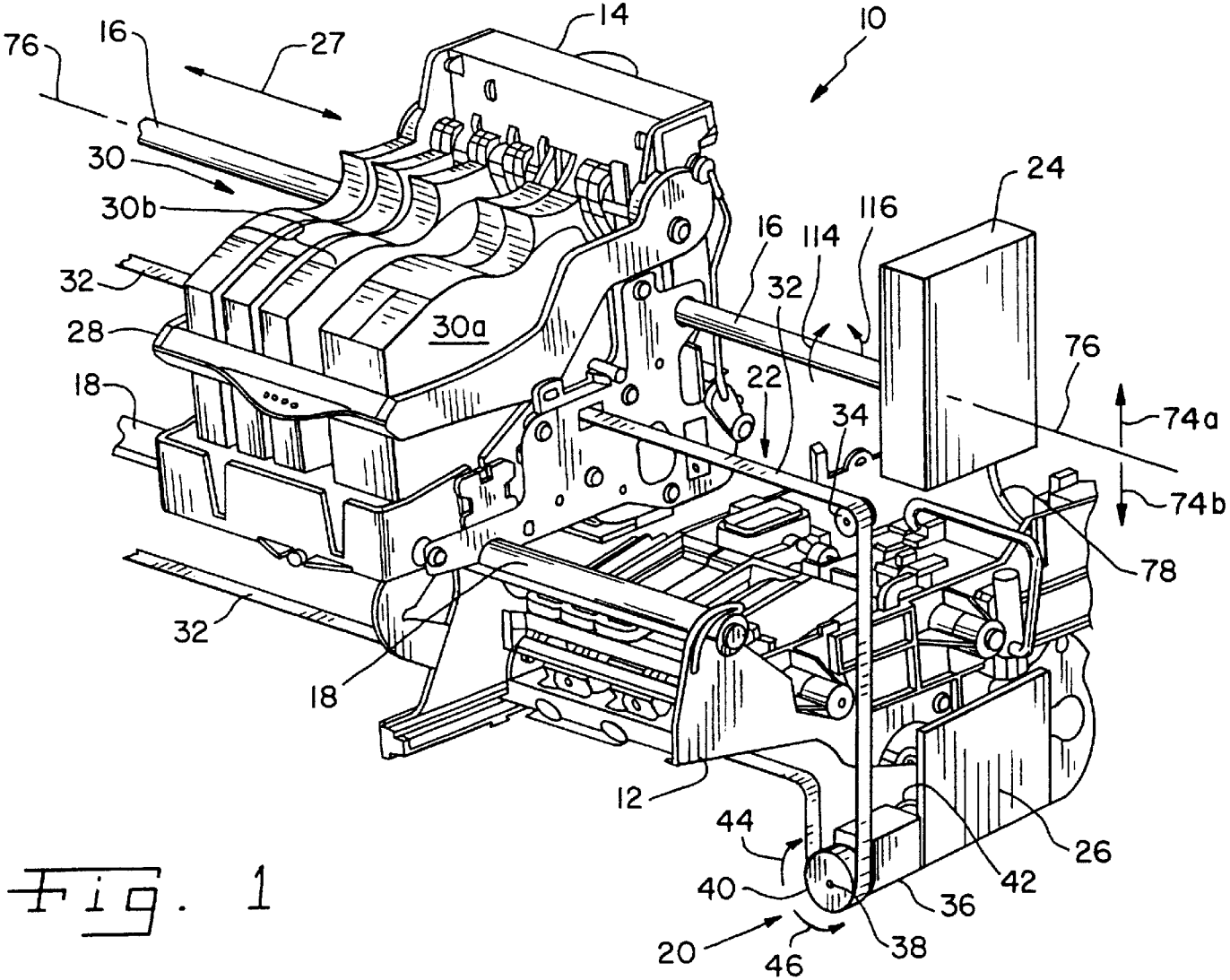
FIG. 1 is a perspective view of a portion of an ink jet printer embodying the present invention.
Figure 2:
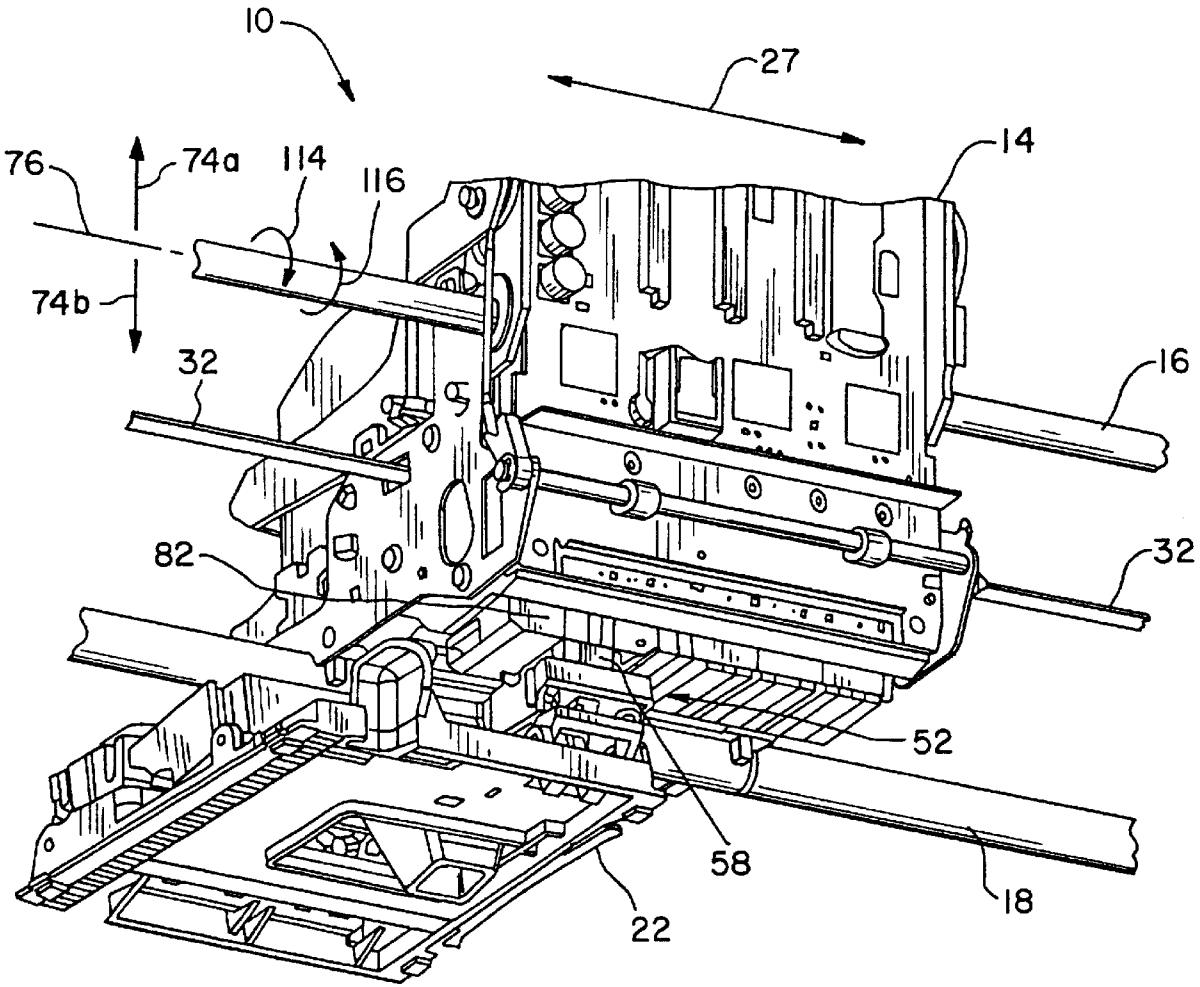
FIG. 2 is a bottom perspective view of the ink jet printer shown in FIG. 1.

Referring now to the drawings and particularly to FIGS. 1 and 2, there is shown a portion of an ink jet printer 10 including a frame 12, printhead carrier 14, a carrier guide rod 16, a carrier guide rod 18, a printhead carrier drive mechanism 20, a maintenance station 22, a printhead-to-print medium gap spacing adjustment mechanism 24 and a controller 26.

Printhead carrier 14 is mounted for reciprocating travel along a bi-directional path 27 defined by the orientation of carrier guide rod 16 and carrier guide rod 18. Printhead carrier 14 is provided with a latching mechanism 28 for mounting a plurality of ink jet printhead cartridge assemblies 30. Ink jet printhead cartridge assemblies 30 are individually identified as a monochrome cartridge assembly 30*a* and a color cartridge assembly 30*b*. Each cartridge assembly may be provided as a printhead cartridge having a printhead and an ink reservoir formed as an integral unit, or as shown having a printhead portion adapted for receiving an ink tank. Color cartridge assembly 30*b* includes one of each of a cyan, magenta and yellow ink tank.

Printhead carrier drive mechanism 20 includes a belt 32, a plurality of pulleys 34 (only one shown) and a carrier drive motor 36. Carrier drive motor 36 includes a rotary shaft 38 having mounted thereon a drive pulley 40. Each of the two ends of belt 32 is coupled to printhead carrier 14. Belt 32 is routed around pulleys 34 and drive pulley 40. Carrier drive motor 36 is electrically connected to controller 26 via an electrical cable 42. Selective actuation of carrier drive motor 36 by controller 26 causes drive pulley 40 to rotate in one of a clockwise direction, depicted by arrow 44, and a counter-clockwise direction, depicted by arrow 46. Thus, ink jet printhead cartridge assemblies 30 are carried by printhead carrier 14 along bi-directional path 27. Bi-directional path 27 defines what is commonly referred to as a printhead scan path.

Figure 3:
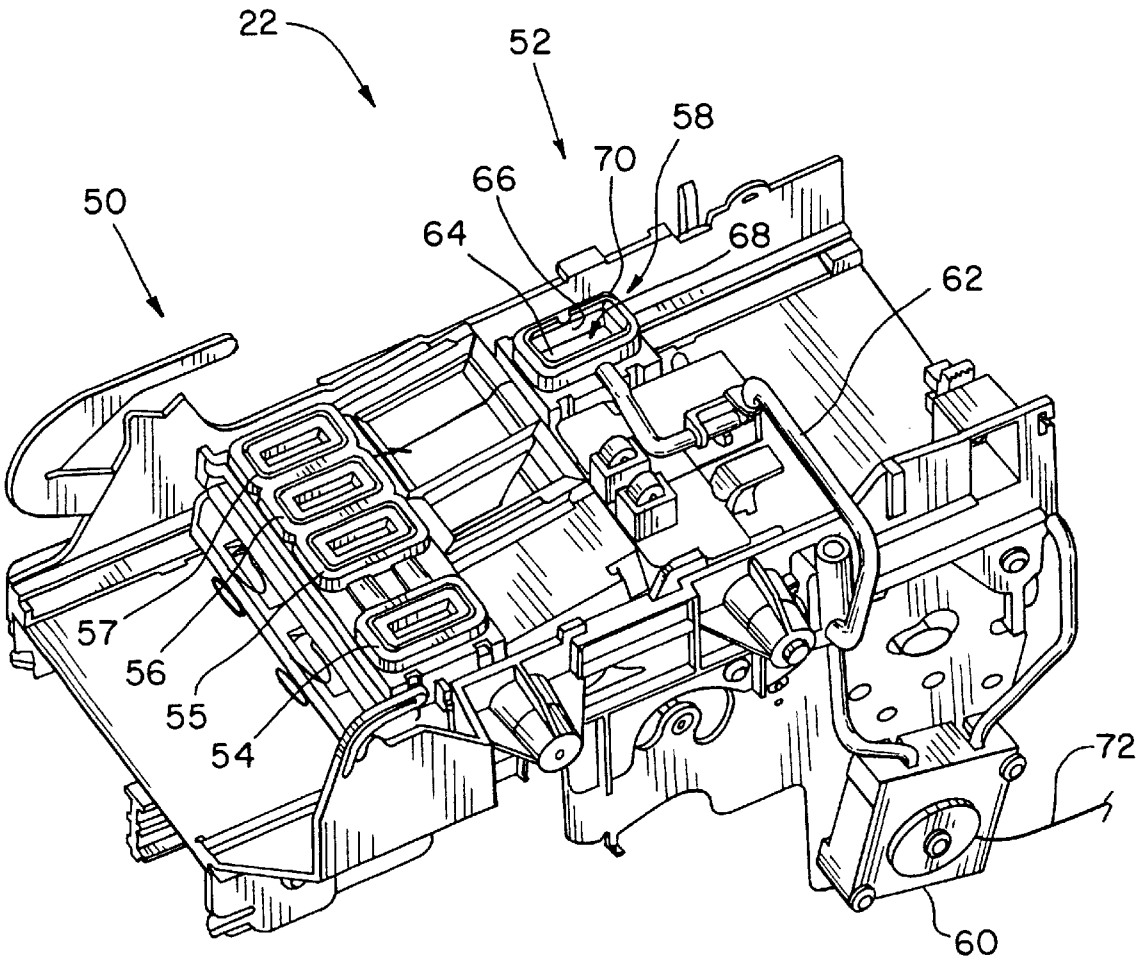
FIG. 3 is a top perspective view of the maintenance station of the ink jet printer shown in FIG. 1.

As can be best seen in FIG. 3, maintenance station 22 includes a capping assembly 50 and a printhead purge mechanism 52. Capping assembly 50 includes a monochrome cap 54 and a plurality of color caps 55, 56 and 57. Monochrome cap 54 is provided for capping the printhead of monochrome cartridge assembly 30*a* during periods of non-use, and color caps 55, 56 and 57 are provided for capping a respective one of the printheads of color cartridge assembly 30*b* during periods of non-use.

Printhead purge mechanism 52 includes a purge cap 58, a pump 60 and a hose, or tube, 62. Preferably, purge cap 58 is made of an elastomeric material, and includes a base 64 and perimetrical sidewalls 66 extending from base 64. Base 64 and perimetrical sidewalls 66 together define an open-topped compliant structure having an interior space 68. A distal end of sidewalls 66 defines a perimeterical sealing lip 70. A spring (not shown) is positioned under purge cap 58 to apply an upward biasing force to purge cap 58. Hose 62 is connected to be in fluid communication with interior space 68 of purge cap 58 and in fluid communication with pump 60, thereby facilitating fluid communication between purge cap 58 and pump 60. Preferably, pump 60 is of the negative pressure generating type, i.e., a vacuum pump. Pump 60 includes a motor that is electrically connected to controller 26 via an electrical cable 72 and is selectively activated by controller 26.

Referring again to FIG. 1, printhead-to-print medium gap spacing adjustment mechanism 24 is provided to adjust a gap between the printheads of cartridge assemblies 30 and a sheet of print media. Spacing mechanism 24 may be implemented, for example, by mounting the ends of carrier guide rod 16 in eccentric bushing sets, such that rotation of guide rod 16 will result in a rotation of an eccentric portion of the eccentric bushing sets thereby causing a deflection, such as a vertical deflection in the directions depicted by arrows 74*a* and 74*b* (referred to collectively as directions 74), of guide rod 16 in a direction substantially orthogonal to an axis 76 of guide rod 16. To effect rotation of guide rod 16, mechanism 24 includes a motor (not shown) electrically coupled to controller 26 via an electrical cable 78 and having a rotary shaft mechanically coupled to guide rod 16 through a gear train (not shown).

Controller 26 includes processing circuitry, including a microprocessor and associated memory. Controller 26 executes preprogrammed instructions to control the bi-directional movement of cartridge assemblies 30 along bi-directional path 27 and the bi-directional movement of cartridge assemblies 30 in the directions depicted by arrows 74*a* and 74*b*, wherein directions 74 are orthogonal, or at least substantially orthogonal, to the directions of bi-directional path 27.

Figure 4:
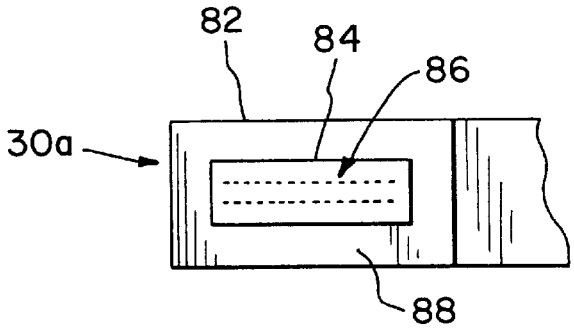
FIG. 4 is a bottom view of a monochrome printhead assembly used in the ink jet printer shown in FIG. 1.

Referring to FIG. 4, there is shown a bottom view of a portion of monochrome cartridge assembly 30*a*. Monochrome cartridge assembly 30*a* includes a monchrome printhead 82 having printhead nozzle plate 84 including a plurality of monochrome ink jetting nozzles 86, and a sealing surface 88 that extends around printhead nozzle plate 84. Sealing surface 88 may be formed by a substrate of a tape automated bonding (TAB) circuit that facilitates electrical connection to the actuators (not shown) associated with ink jetting nozzles 86.

Figure 5:
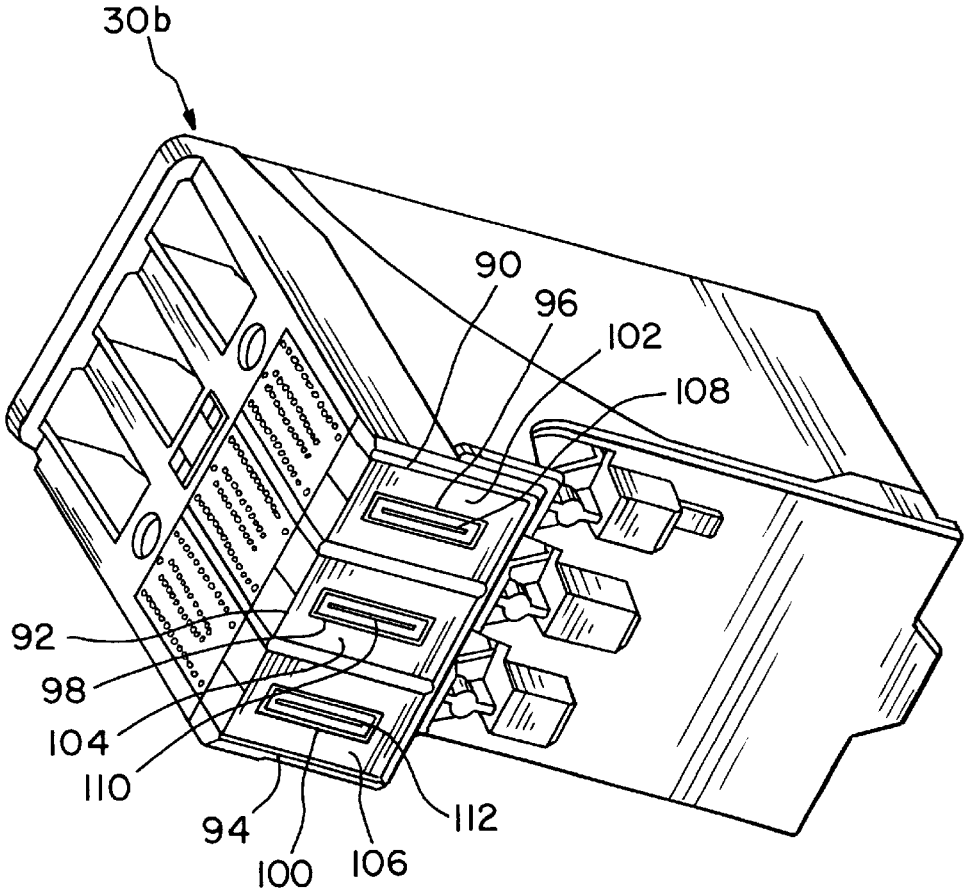
FIG. 5 is a bottom perspective view of a color printhead assembly used in the ink jet printer shown in FIG. 1.

Referring to FIG. 5, there is shown a bottom view of a portion of color cartridge assembly 30*b*. Color cartridge assembly 30*b* includes color printheads 90, 92 and 94. Each of color printheads 90, 92 and 94 has a printhead nozzle plate 96, 98 and 100, respectively, and a sealing surface 102, 104 and 106, respectively, that extends around the associated printhead nozzle plate. Each printhead nozzle plate 96, 98, 100 includes a plurality of color ink jetting nozzles 108, 110 and 112, respectively. Each of sealing surfaces 102, 104, 106 may be formed by a substrate of a TAB circuit that facilitates electrical connection to the actuators (not shown) associated with ink jetting nozzles 108, 110, and 112, respectively.

During operation of the invention, one of the printheads 82, 90, 92 and 94 is selected to undergo a vacuum purge operation to remove obstructions, such as micro bubbles, viscous plugs and contaminants, from the plurality of nozzles and the region adjacent thereto. In order to do so, purge cap 58 must form an airtight seal against the respective one of sealing surfaces 88, 102, 104, 106 that encircle the respective printhead nozzle plates 84, 96, 98, 100. A vacuum is then created in interior space 68 of purge cap 58 by activating pump 60 to purge the printhead. The portion of the TAB circuits defining each of sealing surfaces 88, 102, 104, 106 is not perfectly flat and may have an irregular surface. In order to effect robust sealing of purge cap 58 against sealing surfaces 88, 102, 104, 106, a preferred embodiment of the present invention uses two motions presently available in printer 10 to exercise perimetrical sealing lip 70 of purge cap 58 against the respective sealing surface of the TAB circuit. Such "exercising" is effected by the generation of a repetitive relative movement between the sealing surface of the printhead and perimetrical sealing lip 70 of purge cap 58 so as to cause perimetrical sealing lip 70 to flex.

Figure 6:
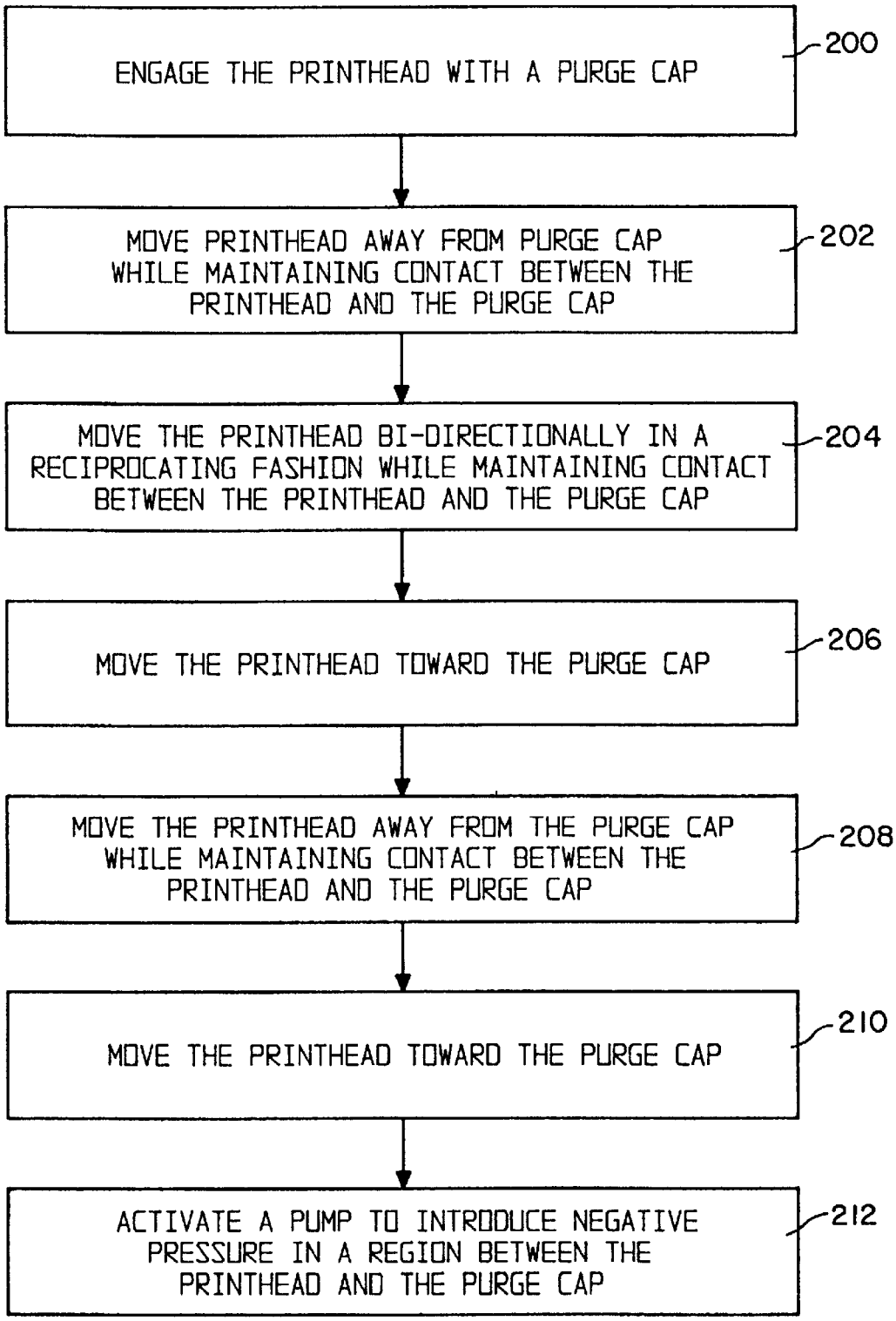
FIG. 6 is a flowchart depicting a process of the present invention.

FIG. 6 shows a flowchart of a process of a preferred embodiment of the present invention. For ease of understanding, the following describes the process of the invention only in relation to the monochrome printhead 82. However, those skilled in the art will recognize that the process of the invention easily can be applied to color printheads 90, 92 and 94.

At step 200, monochrome printhead 82 is brought into engagement with purge cap 58 of printhead purge mechanism 52 (see FIG. 2). Engagement occurs when sealing surface 88 of printhead 82 (see FIG. 4) and perimetrical sealing lip 70 of purge cap 58 (see FIG. 3) are brought into contact. In the embodiment illustrated in FIGS. 1–4, this engagement occurs by positioning purge cap 58 under monochrome printhead 82 within bi-directional path 27, and then vertically moving (lowering) monochrome printhead 82 in the direction indicated by arrow 74*b* by actuating printhead-to-print medium gap spacing adjustment mechanism 24 to rotate carrier guide rod 16 in the direction indicated by arrow 114.

As an alternative, purge cap 58 could be raised into engagement with monochrome printhead 82.

At step 202, printhead 82 is moved in a first direction 74*a* away from purge cap 58 while maintaining contact between sealing surface 88 of printhead 82 and perimetrical sealing lip 70 of purge cap 58. This movement in direction 74*a* decreases the contact force between sealing surface 88 of printhead 82 and perimetrical sealing lip 70 of purge cap 58. This movement is effected by vertically moving (raising) printhead 82 in first direction 74*a* by actuating printhead-to-print medium gap spacing adjustment mechanism 24 to rotate carrier guide rod 16 in the direction indicated by arrow 116.

As an alternative, purge cap 58 could be lowered to decrease the contact force between sealing surface 88 of printhead 82 and perimetrical sealing lip 70 of purge cap 58.

At step 204, printhead 82 is moved bi-directionally in a reciprocating fashion along bi-directional path 27 while maintaining contact between sealing surface 88 of printhead 82 and perimetrical sealing lip 70 of purge cap 58. This movement is effected by actuating printhead carrier drive mechanism 20, and in particular, by rocking drive pulley 40 of carrier drive motor 36 rapidly back and forth, thereby inducing a vibration. The vibration of printhead carrier 14, and in turn printhead 82, is accomplished by applying a small DC voltage for a short period of time to carrier drive motor 36. The polarity of the DC voltage is then immediately reversed for a similar period of time. This cycle is then repeated, causing printhead 82 to vibrate for the desired duration.

As an alternative, purge cap 58 could be vibrated side-to-side or front-to-rear with respect to printhead 82 while maintaining contact between sealing surface 88 of printhead 82 and perimetrical sealing lip 70 of purge cap 58.

At step 206, printhead 82 is moved in a second direction 74*b* toward purge cap 58. This movement in direction 74*b* increases the contact force between sealing surface 88 of printhead 82 and perimetrical sealing lip 70 of purge cap 58. This movement is effected by vertically moving (lowering) printhead 82 in direction 74*b* by actuating printhead-to-print medium gap spacing adjustment mechanism 24 to rotate carrier guide rod 16 in the direction indicated by arrow 114.

Again, as an alternative, purge cap 58 could be raised to increase the contact force between sealing surface 88 of printhead 82 and perimetrical sealing lip 70 of purge cap 58.

At step 208, printhead 82 is moved again in first direction 74*a* away from purge cap 58 while maintaining contact between sealing surface 88 of printhead 82 and perimetrical sealing lip 70 of purge cap 58. This movement in direction 74*a* decreases the contact force between sealing surface 88 of printhead 82 and perimetrical sealing lip 70 of purge cap 58. This movement is effected by vertically moving (raising) printhead 82 in the first direction 74*a* by actuating printhead-to-print medium gap spacing adjustment mechanism 24 to rotate carrier guide rod 16 in the direction indicated by arrow 116.

Again, as an alternative, purge cap 58 could be lowered to decrease the contact force between sealing surface 88 of printhead 82 and perimetrical sealing lip 70 of purge cap 58.

At step 210, printhead 82 is moved again in second direction 74*b* toward purge cap 58. This movement in direction 74*b* increases the contact force between sealing surface 88 of printhead 82 and perimetrical sealing lip 70 of purge cap 58. This movement is effected by vertically moving (lowering) printhead 82 in the direction indicated by arrow 74*b* by actuating printhead-to-print medium gap spacing adjustment mechanism 24 to rotate carrier guide rod 16 in the direction indicated by arrow 114.

Again, as an alternative, purge cap 58 could be raised to increase the contact force between sealing surface 88 of printhead 82 and perimetrical sealing lip 70 of purge cap 58.

At step 212, pump 60 of printhead purge mechanism 52 is activated to introduce a negative pressure in a region, i.e., interior space 68, between printhead 82 and purge cap 58. The application of the negative pressure in interior space 68 removes micro bubbles and viscous plugs from the ink jetting nozzles 86, as well as residual ink and contaminants from printhead nozzle plate 84 and the portion of sealing surface 88 within the confines of perimetrical sealing lip 70.

Preferably, the directions associated with the reciprocating bi-directional movement of printhead 82 along bi-directional path 27 are orthogonal to, or at least substantially orthogonal to, first direction 74*a* and second direction 74*b*. The lifting and lowering of carrier guide rod 16 in turn raises and lowers printhead 82 in directions 74*a* and 74*b* to vertically pulsate purge cap 58, and the rapid reciprocating movement of printhead 82 in the directions of bi-directional path 27 causes printhead 82 to vibrate while in contact with purge cap 58, thereby improving the seal by allowing purge cap 58 to flex and conform to the TAB circuit topography at sealing surface 88.

In general, the amplitude of the vibration of printhead carrier 14, and in turn printheads 82, 90, 92 and 94, is a function of the voltage applied to carrier drive motor 36. A period of vibration is the total time to apply both the positive and then the negative voltages. A number of cycles of the vibration is the number of the periods of vibrations, or repetitions. The selection of the amplitude, the period and the number of cycles of vibration is critical to obtaining a good seal, and is determined empirically. Too much amplitude or too long of a period can move the respective printhead off of purge cap 58, cause excessive noise, or cause excessive machine vibration. Too little amplitude will not generate enough motion to effectively seal the respective printhead. As applied to the embodiment of FIGS. 1–4, it has been determined that an amplitude of three volts applied for a 30 millisecond period and repeated for ten cycles provides for a total vibration time of 300 milliseconds and allows enough printhead movement to best improve the seal of the printhead to the purge cap, yet not so much that it generates excessive noise and machine vibration. Those skilled in the art will recognize that the amplitude, period and number of cycles may require variation from the exemplary values set forth above depending on the characteristics of the printer and printhead purge mechanism with which the process of the present invention is being used.

While the preferred embodiment of the present invention described above uses two motions presently available in printer 10 to exercise perimetrical sealing lip 70 of purge cap 58 against the respective sealing surface of the printhead, it is recognized that satisfactory results can be achieved by utilizing only one of the two available motions. Thus, the invention can be adapted for use in an ink jet printer having at least one range of printhead motion.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of improving a sealing between a purge cap and a printhead having a sealing surface surrounding a plurality of ink jetting nozzles, comprising the steps of:

providing said purge cap with a perimetrical sealing lip; and exercising said perimetrical sealing lip of said purge cap against said sealing surface of said printhead, said exercising being effected by generating a repetitive movement between said sealing surface of said printhead and said perimetrical sealing lip of said purge cap while maintaining contact between said printhead and said perimetrical sealing lip.

2. The method of claim 1, wherein said repetitive relative movement is effected by a rapid and repeating change in direction of movement of said printhead, thereby inducing a vibration in said printhead.

3. A method of improving a sealing between a purge cap and a printhead having a sealing surface surrounding a plurality of ink jetting nozzles, comprising the steps of:

providing said purge cap with a perimetrical sealing lip; and exercising said perimetrical sealing lip of said purge cap against said sealing surface of said printhead, said exercising being effected by generating a repetitive relative movement between said sealing surface of said printhead and said perimetrical sealing lip of said purge cap, wherein the step of exercising comprises the steps of:

engaging said printhead with said purge cap; and moving said printhead bi-directionally in a reciprocating fashion while maintaining contact between said printhead and said purge cap.

4. A method of improving a sealing between a purge cap and a printhead having a sealing surface surrounding a plurality of ink jetting nozzles, comprising the steps of:

providing said purge cap with a perimetrical sealing lip; and exercising said perimetrical sealing lip of said purge cap against said sealing surface of said printhead, said exercising being effected by generating a repetitive relative movement between said sealing surface of said printhead and said perimetrical sealing lip of said purge cap, wherein the step of exercising comprises the steps of:

engaging said printhead with said purge cap; and moving said printhead bi-directionally in a reciprocating fashion while maintaining contact between said printhead and said purge cap, and wherein said printhead is moved along a printhead scan path.

5. A method of improving a sealing between a purge cap and a printhead having a sealing surface surrounding a plurality of ink jetting nozzles, comprising the steps of:

providing said purge cap with a perimetrical sealing lip; and exercising said perimetrical sealing lip of said purge cap against said sealing surface of said printhead, said exercising being effected by generating a repetitive relative movement between said sealing surface of said printhead and said perimetrical sealing lip of said purge cap, wherein the step of exercising comprises the steps of:

engaging said printhead with said purge cap;

moving said printhead in a first direction away from said purge cap while maintaining contact between said printhead and said purge cap; and moving said printhead in a second direction toward said purge cap.

6. The method of claim 5, wherein said first direction and said second direction are substantially orthogonal to a printhead scan path.

7. A method of improving a sealing between a purge cap and a printhead having a sealing surface surrounding a plurality of ink jetting nozzles, comprising the steps of:

providing said purge cap with a perimetrical sealing lip; and exercising said perimetrical sealing lip of said purge cap against said sealing surface of said printhead, said exercising being effected by generating a repetitive relative movement between said sealing surface of said printhead and said perimetrical sealing lip of said purge cap, wherein the step of exercising comprises the steps of:

engaging said printhead with a purge cap;

moving said printhead in a first direction away from said purge cap while maintaining contact between said printhead and said purge cap;

moving said printhead bi-directionally in a reciprocating fashion while maintaining contact between said printhead and said purge cap; and moving said printhead in a second direction toward said purge cap.

8. The method of claim 7, further comprising the steps of:

again moving said printhead in said first direction away from said purge cap while maintaining contact between said printhead and said purge cap; and again moving said printhead in said second direction toward said purge cap.

9. The method of claim 7, wherein directions associated with the bi-directional movement of said printhead are substantially orthogonal to at least one of said first direction and said second direction.

10. The method of claim 7, wherein said first direction and said second direction are substantially orthogonal to a printhead scan path.

11. A method of improving a sealing between a purge mechanism and a printhead having a plurality of ink jetting nozzles, comprising the steps of:

engaging said printhead with a purge cap;

moving said printhead in a first direction away from said purge cap while maintaining contact between said printhead and said purge cap;

moving said printhead bi-directionally in a reciprocating fashion while maintaining contact between said printhead and said purge cap; and moving said printhead in a second direction toward said purge cap.

12. The method of claim 11, further comprising the steps of:

again moving said printhead in said first direction away from said purge cap while maintaining contact between said printhead and said purge cap; and again moving said printhead in said second direction toward said purge cap.

13. The method of claim 12, further comprising the step of activating a pump to introduce a negative pressure in an interior space between said printhead and said purge cap to apply a vacuum to said plurality of ink jetting nozzles.

14. The method of claim 11, wherein directions associated with the bi-directional movement of said printhead are substantially orthogonal to at least one of said first direction and said second direction.

15. The method of claim 11, wherein the step of moving said printhead bi-directionally results in a rapid and repeating change in direction of movement of said printhead, thereby inducing a vibration in said printhead.

16. A method of improving a sealing between a purge mechanism and a printhead, comprising the sequential steps of:

engaging said printhead with a purge cap;

moving said printhead in a first direction away from said purge cap while maintaining contact between said printhead and said purge cap;

moving said printhead bi-directionally in a reciprocating fashion while maintaining contact between said printhead and said purge cap; and moving said printhead in a second direction toward said purge cap.

17. The method of claim 16, further comprising the sequential steps of:

again moving said printhead in said first direction away from said purge cap while maintaining contact between said printhead and said purge cap; and again moving said printhead in said second direction toward said purge cap.

18. The method of claim 17, further comprising the sequential step of activating a pump to introduce a negative pressure in an interior space between said printhead and said purge cap.

19. The method of claim 16, wherein directions associated with the bi-directional movement of said printhead are substantially orthogonal to at least one of said first direction and said second direction.

20. The method of claim 16, wherein the step of moving said printhead bi-directionally results in a rapid and repeating change in direction of movement of said printhead, thereby inducing a vibration in said printhead.

21. A method of sealing a purge mechanism to a printhead surface of a printhead, comprising the steps of:

engaging said printhead surface with a purge cap;

vertically raising said printhead while maintaining contact between said printhead surface and said purge cap;

horizontally moving said printhead bi-directionally in a reciprocating fashion while maintaining contact between said printhead surface and said purge cap; and vertically lowering said printhead.

22. The method of claim 21, further comprising the steps of:

again vertically raising said printhead while maintaining contact between said printhead surface and said purge cap; and again vertically lowering said printhead.

23. The method of claim 22, further comprising the step of activating a pump to introduce a negative pressure in an interior space between said printhead and said purge cap.

24. The method of claim 21, wherein the step of horizontally moving said printhead bi-directionally results in a rapid and repeating change in direction of movement of said printhead, thereby inducing a vibration in said printhead.

25. The method of claim 21, wherein said printhead surface is a surface of a tape automated bonding (TAB) circuit.

26. A method of improving a sealing between a purge cap of a purge mechanism and a printhead having a printhead surface, comprising the steps of:

engaging said printhead surface with said purge cap;

decreasing a contact force exerted between said purge cap and said printhead surface while maintaining contact between said printhead surface and said purge cap;

moving at least one of said printhead and said purge cap bi-directionally in a reciprocating fashion while maintaining contact between said printhead surface and said purge cap; and increasing said contact force exerted between said purge cap and said printhead surface.

27. The method of claim 26, further comprising the steps of:

again decreasing said contact force exerted between said purge cap and said printhead surface while maintaining contact between said printhead surface and said purge cap; and again increasing said contact force exerted between said purge cap and said printhead surface.

28. The method of claim 26, further comprising the step of activating a pump to introduce a negative pressure in an interior space between said printhead and said purge cap.

29. The method of claim 26, wherein directions associated with the bi-directional movement of said at least one of said printhead and said purge cap are at least substantially orthogonal to a direction of application of said contact force.

30. The method of claim 26, wherein the step of moving at least one of said printhead and said purge cap bi-directionally in a reciprocating fashion results in a rapid and repeating change in direction of movement of at least one of said printhead and said purge cap, thereby inducing a vibration.

31. The method of claim 26, wherein said printhead surface is a surface of a tape automated bonding (TAB) circuit.

32. The method of claim 26, wherein said printhead surface extends around a printhead nozzle plate having a plurality of ink jetting nozzles.

* * * * *